US006474286B2

(12) United States Patent
Kashima

(10) Patent No.: US 6,474,286 B2
(45) Date of Patent: Nov. 5, 2002

(54) LUBRICANT FILLER STRUCTURE

(75) Inventor: Yukinori Kashima, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/906,586

(22) Filed: Jul. 16, 2001

(65) Prior Publication Data

US 2002/0038635 A1 Apr. 4, 2002

(30) Foreign Application Priority Data

Jul. 14, 2000 (JP) ..... 2000-215164

(51) Int. Cl.[7] ..... F01M 1/00

(52) U.S. Cl. ..... 123/196 R; 123/196 W; 440/88

(58) Field of Search ..... 123/196 R, 196 W, 123/195 C; 440/88

(56) References Cited

U.S. PATENT DOCUMENTS 4,554,892 A * 11/1985 Amemori ..... 123/41.82 R
4,661,076 A 4/1987 Iwai
4,832,641 A 5/1989 Oishi et al.
4,917,638 A 4/1990 Kojima
5,489,227 A 2/1996 Ishida et al.
5,489,243 A 2/1996 Watanabe
5,514,015 A 5/1996 Okazawa
5,899,778 A 5/1999 Hiraoka et al.
5,950,425 A 9/1999 Takahashi et al.
5,984,742 A 11/1999 Kimura et al.
6,017,254 A 1/2000 Katayama et al.
6,082,343 A 7/2000 Oishi et al.
6,135,833 A * 10/2000 Tsunoda ..... 440/88

* cited by examiner

*Primary Examiner*—Noah P. Kamen
(74) *Attorney, Agent, or Firm*—Knobbe, Martens, Olson & Bear, LLP

(57) ABSTRACT

A lubricant filler structure for an internal combustion engine includes a lubricant filler tube having a lower end connected to the crankcase and an upper end forming a filling port. The filler tube is disposed forwardly at an angle with respect to the vertical. The engine also has a cover member through which the lubricant filler structure extends. The cover member and the lubricant filler structure are configured to enhance accessibility of a lubricant filling port by the user.

18 Claims, 4 Drawing Sheets

LUBRICANT FILLER STRUCTURE

PRIORITY INFORMATION

This application is based on and claims priority to Japanese Patent Application No. 2000-215164, filed Jul. 14, 2000, the entire contents of which is hereby expressly incorporated by reference.

BACKGROUND OF THE INVENTION

1. Field of the Invention

This invention relates to an engine for a watercraft, and more particularly to an improved lubrication system of an engine for a watercraft.

2. Description of Related Art

Although two cycle internal combustion engines have been the accepted powerplant for use in outboard motors for a long time, four cycle engines are becoming more popular due to their superior performance. This presents some significant problems to the designer because of the more complicated nature of a four cycle engine when compared to a two cycle engine. One of the complicating factors with applying four cycle engines to outboard motors is the lubrication system design for such engines.

The four-cycle engine has a crankcase which is located generally toward the front of the engine and in which lubricant collects. Once in the crankcase, the lubricant circulates to the various moving components to assure smooth operation and also to reduce wear of those components. The lubricant is added to the engine crankcase when the engine is first put into service, and later as needed. Typically, the lubricant is added into the crankcase through a lubricant filler structure.

The conventional lubricant filler structure is located on the rear side of the engine, opposite from the crankcase. This creates at least two problems. Rear-side positioning of the oil filling unit tends to increase the size of the engine because longer and more complicated conduits are required to direct the lubricant from the rear side into the crankcase, which is located on the front side. In addition to increasing the size of the engine, rear-side positioning of the lubricant filler structure makes the unit inaccessible to a user of a watercraft on which the motor is mounted because the user has to reach from inside the watercraft, beyond the crankcase, and around the casing enclosing the engine.

A need therefore exists for an outboard motor engine with improved access to the lubricant filler structure for an operator who is located in the watercraft on which the motor is mounted.

SUMMARY OF THE INVENTION

Accordingly, one aspect of the present invention involves an outboard motor that comprises a drive unit, and a bracket assembly adapted to be mounted on an associated watercraft to support the drive unit. The drive unit comprises an internal combustion engine. The engine comprises an engine body that includes a crankcase and a moveable member moveable relative to the engine body. The engine body and the moveable member together define a combustion chamber. The engine further comprises an intake passage for introducing air into the combustion chamber. The intake passage extends from a rear portion of the combustion chamber to an external side of the crankcase and to a forward side of the crankcase. The intake passage and the crankcase define a space therebetween. The engine also comprises a lubricant filler structure that includes a cap, and a lubricant filler tube having a lower end connected to the crankcase and an upper end forming a filling port. At least a portion of the lubricant filler structure is disposed within the space defined by the crankcase and the intake passage.

Another aspect of the present invention involves an internal combustion engine comprising an engine body that includes a crankcase and a moveable member moveable relative to the engine body. The engine body and the moveable member together define a combustion chamber. The engine also comprises a lubricant filler structure that comprises a cap, and a lubricant filler tube having a lower end connected to the crankcase and an upper end forming a filling port. The filler tube is disposed forwardly at an angle with respect to the vertical.

A further aspect of the present invention involves an internal combustion engine for use with its crankshaft extending in a generally vertical direction. The internal combustion engine comprises an engine body. The engine body comprises a crankcase member, a cylinder block and a cylinder head. The crankcase member and the cylinder block are joined together to define a crankcase chamber. The crankshaft extends in a generally vertical direction through the crankcase chamber. At least one cylinder bore is formed in the cylinder block and a piston is reciprocally mounted within the cylinder bore. The piston is connected to the crankshaft. A flywheel is secured to the crankshaft and is disposed above an upper surface of the engine body. A cover member extends over the flywheel. An oil fill tube is connected to an upper portion of the crankcase member and the oil fill tube extends away from the cylinder head at an angle.

BRIEF DESCRIPTION OF THE DRAWINGS

These and other features, aspects and advantages of the present invention will now be described with reference to the drawings of the preferred embodiment, which is intended to illustrate and not to limit the invention. The drawings comprise four figures.

DETAILED DESCRIPTION OF THE PREFERRED EMBODIMENTS OF THE INVENTION

Figure 1:
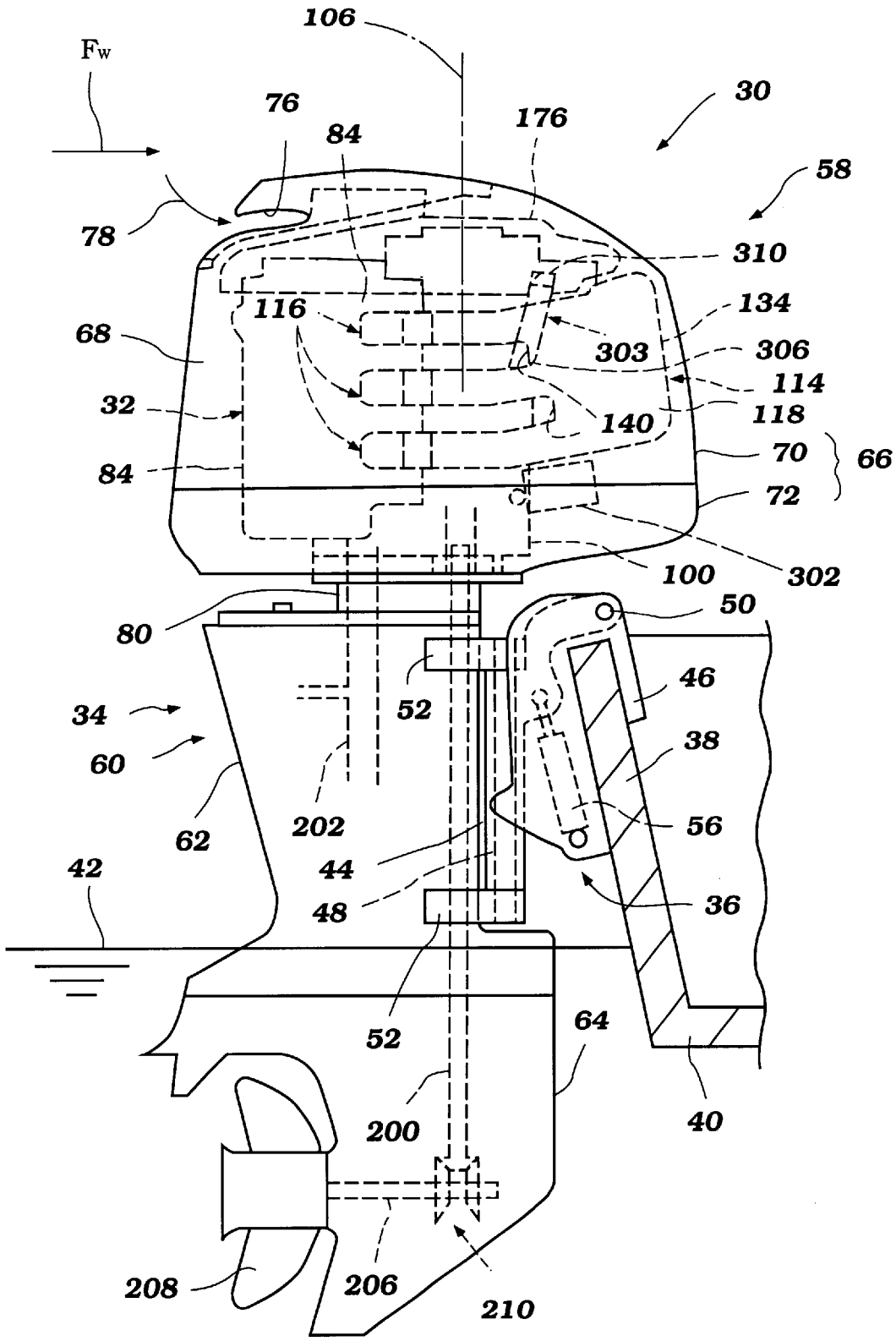
FIG. 1 is a side elevational view of an outboard motor configured in accordance with a preferred embodiment of the present invention. An associated watercraft is partially shown in section.
Figure 2:
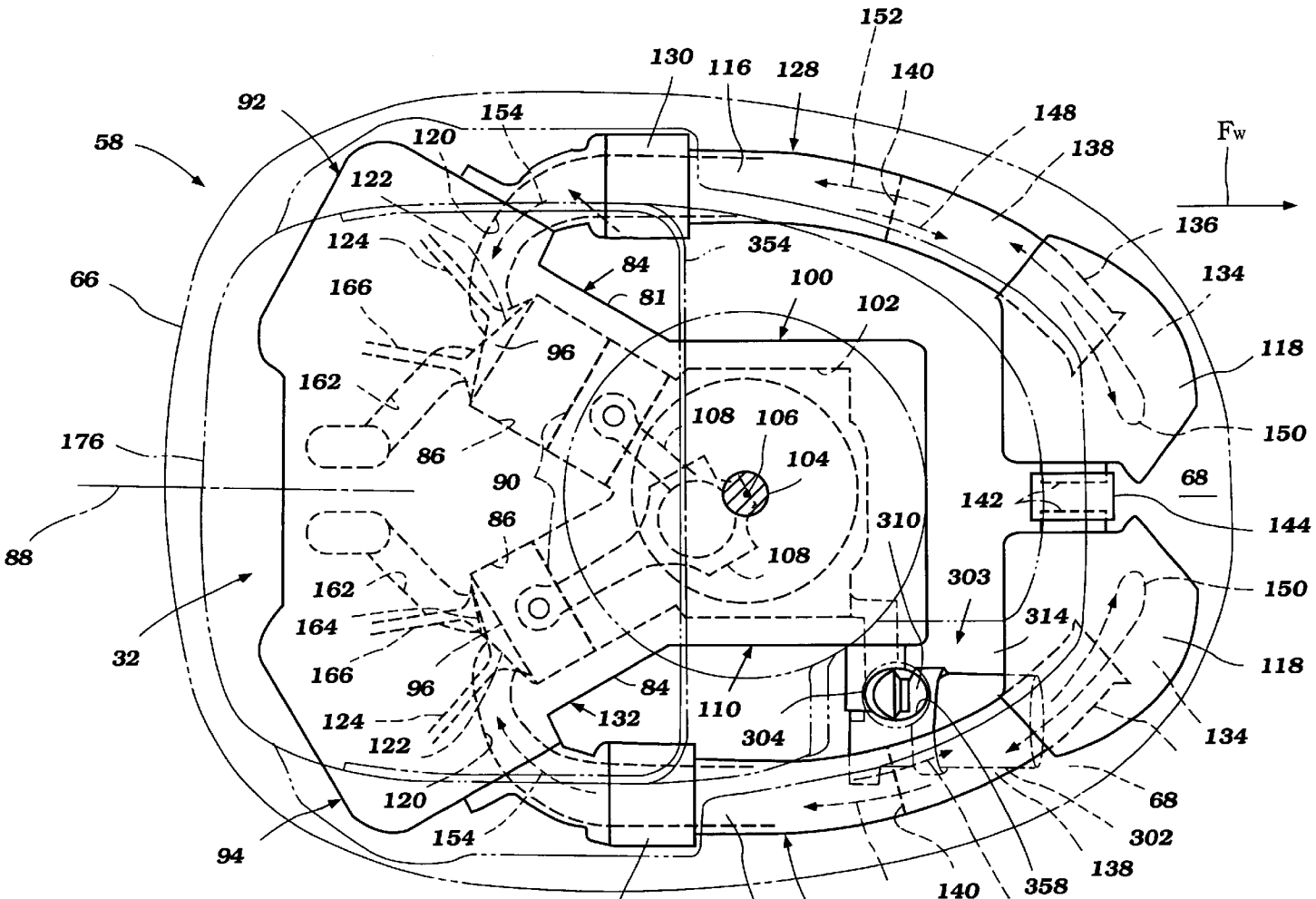
FIG. 2 is a top plan view of an engine of the outboard motor. A protective cowling is shown in phantom.

With reference to FIGS. 1–2, an overall construction of an outboard motor 30 that employs an internal combustion engine 32 configured in accordance with certain features, aspects and advantages of the present invention will be described. The engine 32 has particular utility in the context of a marine drive, such as the outboard motor, and thus is described in the context of an outboard motor. The engine 32, however, can be used with other types of marine drives (i.e., inboard motors, inboard/outboard motors, etc.) and also certain land vehicles. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that are spaced apart from each other and that are affixed to the watercraft transom 38. The pivot pin 50 completes a hinge coupling between the swivel bracket 44 and the clamping bracket 46. The pivot pin 50 extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context of use. The arrow Fw of FIGS. 1–4 generally indicates the forward direction. The terms "rear," "reverse," "backwardly," and "rearwardly" in turn mean at or to the opposite side of the front side also.

A hydraulic tilt and trim adjustment system 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement," when used in a broad sense, comprises both a tilt movement and a trim adjustment movement.

The illustrated drive unit 34 comprises a power head 58 and a housing unit 60 which includes a driveshaft housing 62 and a lower unit 64. The power head 58 is disposed atop the drive housing unit 60 and includes an internal combustion engine 32 that is positioned within a protective cowling assembly 66 that preferably is made of plastic. More particularly, the protective cowling assembly 66 advantageously defines a generally closed cavity 68 in which the engine 32 is disposed. The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic, or repairperson can access the engine 32 for maintenance or for other purposes.

The top cowling member 70 preferably has a rear intake opening 76 on its rear and top portion. A rear intake member with one or more air ducts is unitarily formed with or is affixed to the top cowling member 70. The rear intake member, together with the rear top portion of the top cowling member 70, forms a rear air intake space. Ambient air thus is drawn into the closed cavity 68 through the rear intake opening 76 and further through the air ducts as indicated by the arrow 78 of FIG. 1. Typically, the top cowling member 70 tapers in girth toward its top surface, which is in the general proximity of the air intake opening 76.

With continued reference to FIG. 1, the bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally form a tray. The engine 32 preferably is placed onto this tray and is affixed to the exhaust guide member 80. The exhaust guide member 80 also defines an exhaust discharge passage through which burnt charges (e.g., exhaust gases) from the engine 32 are discharged.

The engine 32 in the illustrated embodiment preferably operates on a four-cycle combustion principle. The presently preferred engine 32 has a cylinder block 84 configured as a V shape as illustrated in FIG. 2. The cylinder block 84 thus defines two banks B1, B2 which extend at an angle to each other. In the illustrated arrangement, the bank B1 is disposed on the port side, while the bank B2 is disposed on the starboard side. In one arrangement, each bank B1, B2 has three cylinder bores 86 so that the cylinder block 84 has six cylinder bores 86 in total. The cylinder bores 86 of each bank B1, B2 extend generally horizontally and are generally vertically spaced from one another. As used in this description, the term "horizontally" means that the subject portions, members or components extend generally in parallel to the water surface 42 when the associated watercraft 40 is substantially stationary with respect to the water surface 42 and when the drive unit 34 is not tilted and is placed in the position shown in FIG. 1. The term "vertically" in turn means those portions, members, or components that extend generally normal to those components that extend horizontally.

The illustrated engine 32 generally has a symmetrical configuration relative to a longitudinal center plane 88 extending generally vertically fore to aft of the outboard motor 30. This type of engine, however, merely exemplifies one type of engine on which various aspects and features of the present invention can be suitably used. Engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 90, moves relative to the cylinder block 84 in a suitable manner. In the illustrated arrangement, a piston 90 reciprocates within each cylinder bore 86.

A cylinder head assembly 92 is affixed to one end of the bank B1 to close that end of the cylinder bores 86 and another cylinder head assembly 94 is affixed to one end of the bank B2 to close that end of the cylinder bores 86. The cylinder head assemblies 92, 94, together with the associated pistons 90 and cylinder bores 86, preferably define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and can be journaled for rotation about a rotational axis 106 by several bearing blocks. The rotational axis 106 preferably is on the longitudinal center plane 88. Connecting rods 108 couple the crankshaft 104 with the respective pistons 90 in any suitable manner. Thus, the crankshaft 104 can rotate with the reciprocal movement of the pistons 90.

Preferably, the crankcase member 100 is located at the most forward position of the engine 32, with the cylinder block 84 and the cylinder head assemblies 92, 94 being disposed rearward from the crankcase member 100, one after another. Generally, the cylinder block 84 (or individual cylinder bodies), the cylinder head assemblies 92, 94 and the crankcase member 100 together define an engine body 110. Preferably, at least these major engine portions 84, 92, 94, 100 are made of aluminum alloy. The aluminum alloy advantageously increases strength over cast iron while decreasing the weight of the engine body 110.

With reference to FIG. 1, the engine 32 also comprises an air induction system 114. The air induction system 114 transfers air from within the cavity 68 to the combustion chambers 96. The air induction system 114 preferably comprises six intake passages 116 and a pair of plenum chambers 118 (see FIG. 2). In the illustrated arrangement, each bank B1, B2 is allotted with three intake passages 116 and one plenum chamber 118.

The downstream-most portions of the intake passages 116 are defined within the cylinder head assemblies 92, 94 as inner intake passages 120. The inner intake passages 120 communicate with the combustion chambers 96 through intake ports 122 which are formed at inner surfaces of the cylinder head assemblies 92, 94. Typically, each combustion chambers 96 has one or more intake ports 122. Intake valves 124 are slideably disposed at each cylinder head assembly 92, 94 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92, 94 and a corresponding retainer that is affixed to each of the valves 124. When each intake valve 124 is in the open position, the inner intake passage 120 that is associated with the intake port 122 communicates with the associated combustion chamber 96.

Outer portions of the intake passages 116 which reside outside of the cylinder head assemblies 92, 94 preferably are defined by intake conduits 128. Each intake conduit 128 includes a control mechanism or throttle valve assembly 130. In the illustrated arrangement, the intake conduit 128 is formed of two pieces with the throttle valve assembly 130 interposed therebetween. The intake conduits 128 and the throttle bodies preferably are made of an aluminum alloy or of plastic. While the intake conduits 128 allotted to the bank B1 extend forwardly along a side surface of the engine body 110 on the port side from the cylinder head assembly 92 to the front of the crankcase member 100, the intake conduits 128 allotted to the bank B2 extend forwardly along a side surface of the engine body 110 on the starboard side from the cylinder head assembly 94 to the front of the crankcase member 100.

Each throttle valve assembly 130 preferably includes a throttle body and a throttle valve disposed within the throttle body. Preferably, the throttle valves are butterfly valves and have valve shafts journaled for pivotal movement about an axis extending generally vertically. In one arrangement, the valve shafts are linked together and are connected to a control linkage and further to an operational member such as a throttle lever preferably provided near the device with which the operator can steer the outboard motor 30. The operator can control opening degrees of the throttle valves through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed.

Figure 3:
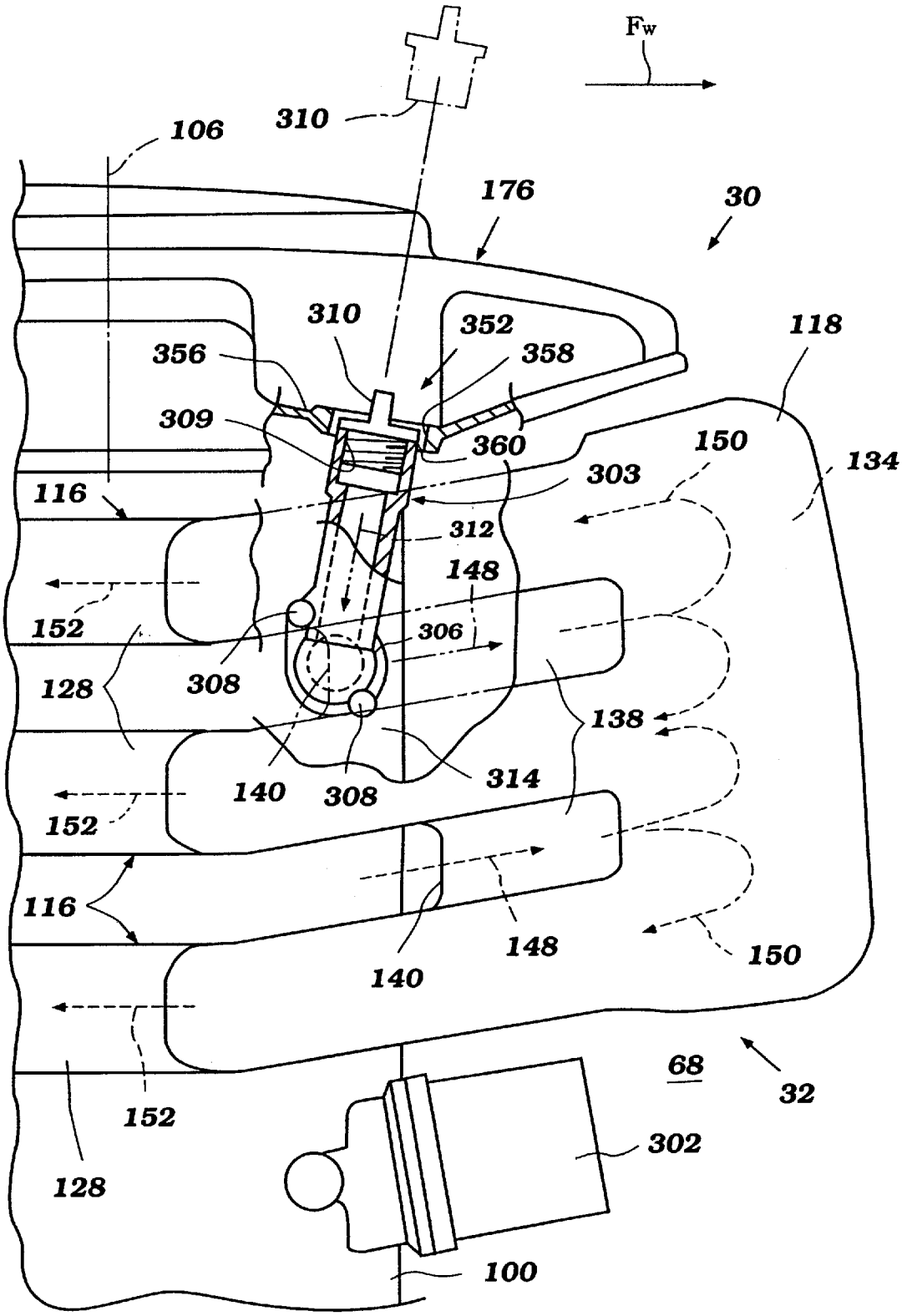
FIG. 3 is an enlarged partial side elevation view of the engine. A cover member is shown partially in section.
Figure 4:
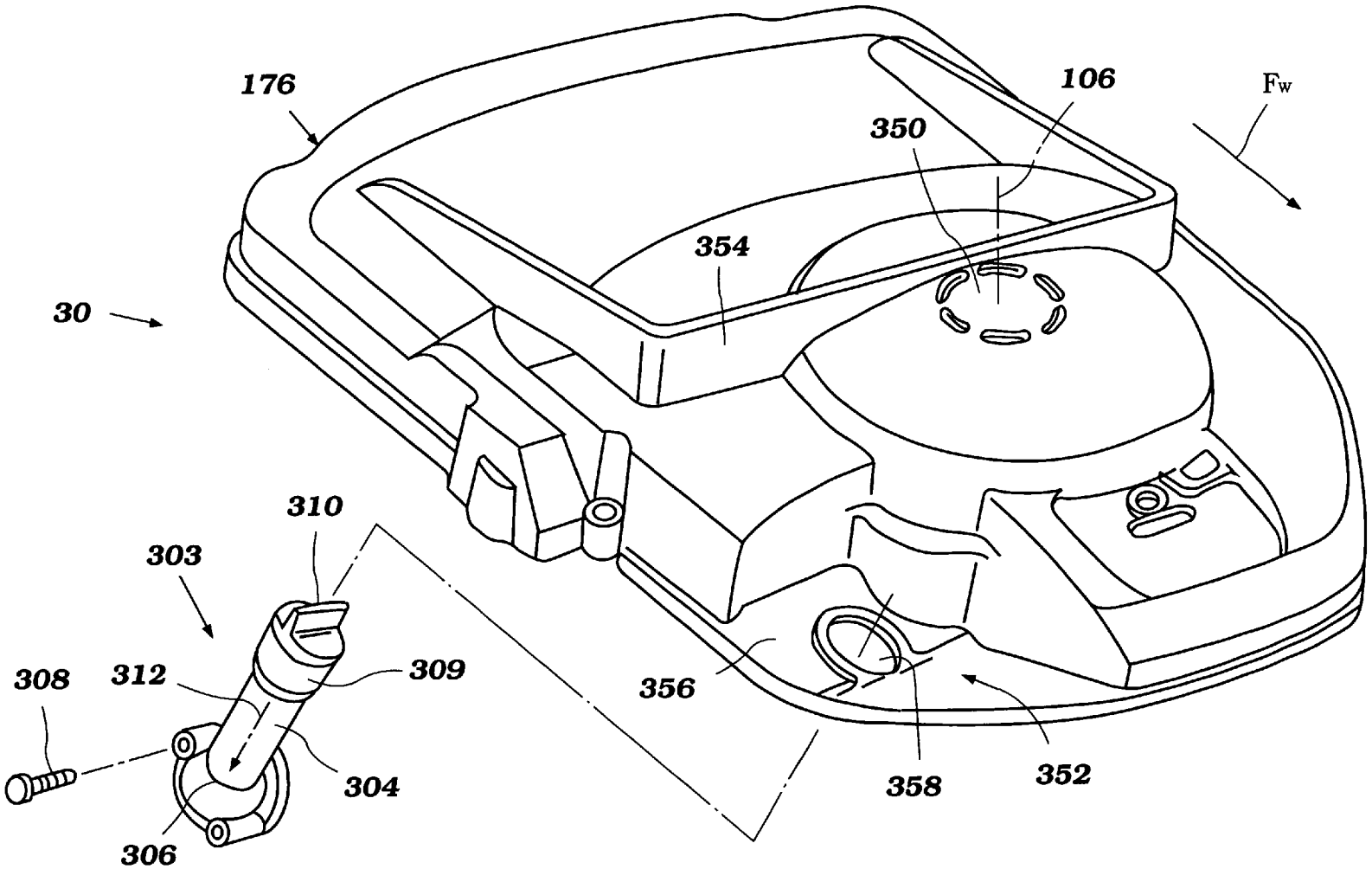
FIG. 4 is an exploded perspective view of the cover member viewed from the starboard side.

The respective plenum chambers 118 preferably are defined with plenum chamber units or voluminous units 134 which are disposed side by side in front of the crankcase member 100. Preferably, the plenum chambers 134 are arranged symmetrically relative to the longitudinal center plane 88. Each forward end portion 136 of the intake conduits 128 is housed within each plenum chamber unit 134. As illustrated in FIG. 3, each plenum chamber unit 134 preferably has two air inlets 138 which extend generally rearwardly between the respective intake conduits 128. That is, two of the intake conduits 128 interpose one inlet 138 therebetween. The respective air inlets 138 define inlet openings 140 through which air is drawn into the plenum chambers 118. The plenum chamber units 134 also have two other openings 142 (see FIG. 2) which are defined on another side and are spaced apart vertically from one another. The openings 142 of one plenum chamber unit 134 are formed opposite to the openings 142 of the other plenum chamber unit 134 and are coupled with each other by balancer pipes 144. The plenum chambers 118 coordinate air delivered to each intake passage 116 and also act as silencers to reduce intake noise. The air in both of the chambers 118 also are coordinated with one another through the balancer pipes 144. The plenum chamber units 134 and the balancer pipes 144 preferably are made of plastic, although they can of course be made of metal material such as, for example, aluminum alloy.

The air within the closed cavity 68 is drawn into the plenum chambers 118 through the inlet openings 140 as indicated by the arrows 148 of FIG. 2. The air expands within the plenum chambers 118 and is calmed before it enters the outer intake passages 116 through the end portions 136 as indicated by the arrows 150 of FIGS. 2 and 3. The air passes through the outer intake passages 116 and flows into the inner intake passages 120 as indicated by the arrows 152, 154 of FIG. 2. As described, amounts of air are measured by the throttle valve assemblies 130 before entering the inner intake passages 120.

The throttle valves can be substantially closed to bring the engine 32 to an idle speed and to maintain this speed. Preferably, the valves are not filly closed to prevent sticking of the throttle valves in the closed position. As used through the description, the term "idle speed" generally means a low engine speed that is achieved when the throttle valves are closed but also includes a state such that the valves are slightly more open to allow a small amount of air to flow through the intake passages 116. Also, the outboard motor 30 is often used for a trolling purpose. Under the trolling operation, a shift mechanism, which will be discussed later, is in a forward position and the engine 32 operates in a low idle speed.

The air induction system 114 preferably includes an idle or auxiliary air delivery mechanism 158 that can deliver idle air to the combustion chambers 96 when, for example, the throttle valves 132 are substantially closed. The delivery mechanism is connected to the air intake passages 116 downstream the throttle valve assemblies 130. The idle air delivery mechanism acts as an idle speed control (ISC) mechanism.

The engine 32 also includes an exhaust system that routes burnt charges, i.e., exhaust gases, to a location outside of the outboard motor 30. Each cylinder head assembly 92, 94 defines inner exhaust passages 162 that communicate with the combustion chambers 96 through one or more exhaust ports 164 defined at the inner surfaces of the respective cylinder head assemblies 92, 94. The exhaust ports 164 can be selectively opened and closed by exhaust valves 166. The construction of each exhaust valve and the arrangement of the exhaust valves are substantially the same as the intake valve and the arrangement thereof, respectively.

An exhaust manifold preferably is defined generally vertically within the cylinder block 84 between the cylinder bores 86 of both the banks B1, B2. The exhaust manifold communicates with the combustion chambers 96 through the inner exhaust passages 162 and the exhaust ports 164 to collect exhaust gases therefrom. The exhaust manifold is coupled with the exhaust discharge passage of the exhaust guide member 80. When the exhaust ports 164 are opened, the combustion chambers 96 communicate with the exhaust discharge passage through the exhaust manifold.

A valve cam mechanism preferably is provided for actuating the intake and exhaust valves 124, 166 in each bank B1, B2. Preferably, the valve cam mechanism includes one or more camshafts per bank that extend generally vertically and that are journaled for rotation relative to the cylinder head assemblies 92, 94. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by the rotation of the camshafts to appropriately actuate the intake and exhaust valves 124, 166.

A camshaft drive mechanism preferably is provided for driving the valve cam mechanism. While the intake and exhaust camshafts comprise intake and exhaust driven sprockets positioned atop the intake and exhaust camshafts, respectively, the crankshaft 104 has a drive sprocket positioned atop thereof. Of course, other locations of the sprockets also can be used. A timing chain or belt is wound around the driven sprockets and the drive sprocket. The crankshaft 104 thus drives the respective camshafts through the timing chain in a timed relationship. Because the camshafts must rotate at half of the speed of the rotation of the crankshaft 104 in the four-cycle combustion principle, a diameter of the driven sprockets generally is twice as large as a diameter of the drive sprocket.

The engine 32 preferably has an indirect port or intake passage fuel injection system. The fuel injection system preferably comprises six fuel injectors with one fuel injector allotted for each of the respective combustion chambers 96. The fuel injectors preferably are mounted on the throttle bodies and a pair of fuel rails connects the respective fuel injectors with each other on each bank B1, B2. The fuel rails also define portions of the fuel conduits to deliver fuel to the injectors.

Each fuel injector preferably has an injection nozzle directed toward the associated intake passage 116 downstream the throttle valve assembly 130. The fuel injectors spray fuel into the intake passages 120 under control of an electronic control unit (ECU). The ECU preferably is disposed between a forward surface of the crankcase member 100 and the plenum chamber unit 134 on the port side, and is mounted on the forward surface of the crankcase member 100. Control signals of the fuel injectors are transmitted to the fuel injectors from the ECU through one or more control lines. The ECU controls both the initiation timing and the duration of the fuel injection cycle of the fuel injectors so that the nozzles spray a proper amount of the fuel per combustion cycle.

Typically, a fuel supply tank disposed on a hull of the associated watercraft 40 contains the fuel. The fuel is delivered to the fuel rails through the fuel conduits and at least one fuel pump arranged between some of the conduits pressurizes the fuel to the fuel rails and finally to the fuel injectors. A vapor separator preferably is disposed between the conduits to separate vapor from the fuel. The vapor is delivered through a vapor delivery circuit to the plenum chamber 118 and then is sent to the combustion chambers 96 together with the air for combustion therein. In some arrangements, the engine 32 can be provided with a ventilation system arranged to send lubricant vapor to the plenum chambers. In such arrangements, the fuel vapor also can be sent to the plenum chambers via the ventilation system. The fuel injection system and the vapor separator are disclosed, for example, in U.S. Pat. Nos. 5,873,347, 5,915,363, and 5,924,409. A direct fuel injection system that sprays fuel directly to the combustion chambers can replace the indirect fuel injection system. Moreover, other charge forming devices, such as carburetors, are applicable instead of the fuel injection systems.

The engine 32 further comprises an ignition system. Each combustion chamber 96 is provided with a spark plug which preferably is disposed between the intake and exhaust valves 124, 166. Each spark plug has electrodes that are exposed into the associated combustion chamber 96 and that are spaced apart from each other with a small gap. The spark plugs are connected to the ECU through control lines and ignition devices such as ignition coils so that ignition timing is also controlled by the ECU. The spark plugs generate a spark between the electrodes to ignite an air/fuel charge in the combustion chamber 96 by means of the ignition coils at selected ignition timing under control of the ECU.

With reference to FIG. 1, a cover member or space forming member 176 also is detachably affixed to the cylinder block 84 by appropriate fasteners, such as bolts, to extend over the majority of the crankcase 100 and the cylinder block 84. Water, thus, is effectively inhibited from splashing onto the top of the crankcase 100 and the cylinder block 84. The cover member 176 will be described in greater detail below.

For the purpose of control by the ECU, the engine 32 may have various sensors. These may include a crankshaft angle position sensor, an air intake pressure sensor, and a throttle valve position sensor, for example. The sensors may send signals through hardwired connections, emitter and detector pairs, infrared radiation, radio waves or the like. The type of signal and the type of connection can be varied between sensors or the same type can be used with all sensors.

A flywheel assembly preferably is positioned above atop the crankshaft 104 and is mounted for rotation with the crankshaft 104. The flywheel assembly comprises a flywheel magneto or AC generator that supplies electric power to various electrical components such as the fuel injection system, the ignition system and the ECU.

With reference again to FIG. 1, the driveshaft housing 62 depends from the power head 58 to support a driveshaft 200 which is coupled with the crankshaft 104 and which extends generally vertically through the driveshaft housing 62. The driveshaft 200 is journaled for rotation and is driven by the crankshaft 104. The driveshaft housing 62 preferably defines an internal section 202 of the exhaust system that leads the majority of exhaust gases to the lower unit 64. The exhaust internal section 202 is schematically shown in FIG. 1 to include a portion of the exhaust manifold and the exhaust discharge passage.

The lower unit 64 depends from the driveshaft housing 62 and supports a propulsion shaft 206 that is driven by the driveshaft 200. The propulsion shaft 206 extends generally horizontally through the lower unit 64 and is journaled for rotation. A propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 such as by bevel gears. The illustrated outboard motor 30 preferably has a clutch mechanism that allows the transmission 210 to change the rotational direction of the propeller 208 among forward, neutral, and reverse.

The lower unit 64 also defines an internal section of the exhaust system that is connected with the internal exhaust section 202 of the driveshaft housing 62. At engine speeds above idle, the exhaust gases generally are discharged to the body of water surrounding the outboard motor 30 through the internal sections and then a discharge section defined within the hub of the propeller 208. Incidentally, the exhaust system can include a catalytic device at any suitable location in the exhaust system to purify the exhaust gases.

Now with reference to FIGS. 1–4, the engine 32 may further comprise a lubrication system 300. The lubrication system 300 comprises a lubricant filter 302 and a lubricant filler structure 303. The lubricant filler structure 303 comprises a lubricant filler tube 304 that extends vertically outward from a lower end 306 connected to the crankcase 100 by one or more fasteners 308. The fasteners 308 can be bolts or any other suitable fastener. An upper end of the lubricant filler tube 304 forms a lubricant filling port 309 (see FIG. 3). A cap 310 is configured to removeably seal the filling port 309. Lubricant 312 is added to the lubrication system 300 through the lubricant filler tube 304. Preferably, the lubricant filler tube 304 is located on the starboard side of the crankcase and is tilted so that the port 309 is further forward than the lower end 306. Also, at least a portion of the lubricant filler structure 303, such as the lubricant filler tube 304, is located in a space 314 defined by the crankcase 100 and the intake passages 116. By locating at least a portion of the lubricant filler structure 303 in the space 314, the overall size of the engine 32, and therefore, the outboard motor 30 can be reduced. The reduction in size of the motor 30 reduces drag on the motor and the associated watercraft 40, which improves many performance metrics.

The cover member 176, as mentioned above, is located on the top of the engine 32. In some advantageous arrangements, the cover member 176 forms a barrier that inhibits water from contacting structures disposed directly beneath it. The cover member 176 comprises an upper region 350, a recess 352, and a rib 354 (see FIG. 4). The recess 352 further comprises a low region 356 and an opening 358. In the preferred embodiment, the upper region 350 is vertically above the center of the crankshaft axis 106 and covers at least a portion of the flywheel assembly, the rib 356 extends above the upper region 350, and the recess 352 is positioned toward the watercraft 40 relative to these portions.

The opening 358 is positioned on the cover member 176 such that the lubricant filler structure 303 extends up to it when the cover member 176 is mounted on the engine 32. Preferably, the port 309 extends to the opening 358 but not above it. In another variant, the filler tube 304 extends to an elevation above the opening 358. The filler tube 304 and the opening 358 are preferably configured so that a space 360 is created therebetween. Because the space 360 is located near the bottom of the recess 352, it can be used to drain the recess should liquid collect there.

In some advantageous arrangements, the recess 352 extends to the edge of the cover member 176. This makes pouring lubricant into the filler structure 303 easier because the container from which the lubricant is poured may be positioned very near to the port 309. This shortens the pour distance (i.e. the distance that lubricant travels from the container from which it is poured to the port 309). As a result, the user can pour the lubricant into the port 309 more accurately, thereby minimizing lubricant spillage.

In another variant, a raised ridge may extend around the outside of the recess 352. In that case, it may be preferable to configure the cover member 176 and the filler structure 303 so as to eliminate the space 360. In this arrangement, any lubricant that does not flow into the port 309 but that does flow into the recess 352 is directed into the filler structure 303 by the recess. In this embodiment, the recess 352 acts to funnel liquid into the filler structure 303.

Preferably, the highest elevation of any point on the cap 310 is at an elevation below the upper region 350. Such a construction advantageously reduces the vertical dimension of the motor, which, in turn, reduces wind resistance during movement of the watercraft.

Thus, from the foregoing description, it should be readily apparent that the described embodiment of the lubricant filler structure provide a lubricant filler structure that maintains the compactness of the associated marine engine and that can be accessed from a water vehicle on which the engine is mounted. Of course, the foregoing description is that of a preferred embodiment of the lubricant filler structure and various changes and modifications may be made without departing from the spirit and scope of the appended claims.

What is claimed is:

1. An outboard motor comprising a drive unit, a bracket assembly adapted to be mounted on an associated watercraft to support the drive unit, a cowling assembly, the drive unit comprising an internal combustion engine, the engine comprising an engine body including a crankcase, a moveable member moveable relative to the engine body, the engine body and the moveable member together defining a combustion chamber, the engine further comprising an intake passage for introducing air into the combustion chamber, the intake passage extending from a rear portion of the combustion chamber, the intake passage further extending to an external side of the crankcase and to a forward side of the crankcase, the intake passage and the crankcase defining a space therebetween, and a lubricant filler structure, comprising a cap, and a lubricant filler tube having a lower end connected to the crankcase and an upper end forming a filling port, at least a portion of the lubricant filler structure being disposed within the space defined by the crankcase and the intake passage.

2. The outboard motor of claim 1, further comprising a cover member having a hole for receiving the lubricant filling port, at least a portion of the cover member being disposed within the cowling assembly, wherein the lubricant filler structure is configured to extend from the crankcase to the hole.

3. The outboard motor of claim 2, wherein the cover member further comprises a recess, the hole being located in the recess and wherein the highest elevation of the cap is below the highest elevation of the cover member.

4. The outboard motor of claim 3, wherein the filler tube is disposed forwardly of the crankcase at an angle with respect to the vertical.

5. The outboard motor of claim 1, further comprising a cover member having a hole for receiving the lubricant filling port, at least a portion of the cover member being disposed within the cowling assembly, wherein the lubricant filler structure is configured to extend from the crankcase to an elevation above the hole.

6. An internal combustion engine comprising a cowling assembly, an engine body including a flywheel assembly, a crankcase, a moveable member moveable relative to the engine body, the engine body and the moveable member together defining a combustion chamber, the engine further comprising an induction system, the engine body and the induction system defining a space therebetween, and a lubricant filler structure comprising a cap and a lubricant filler tube having a lower end connected to the crankcase and an upper end forming a filling port, at least a portion of the lubricant filler structure positioned within the space, wherein the filler tube is disposed forwardly at an angle with respect to the vertical.

7. The internal combustion engine of claim 6, wherein a portion of the filler structure and a portion of the flywheel assembly are within a same vertical transverse plane.

8. The internal combustion engine of claim 7, wherein the lower end of the filler tube is connected to the engine on the forward side of the engine.

9. The internal combustion engine of claim 6, wherein the filler tube and the crankcase are unitary.

10. The internal combustion engine of claim 6, further comprising a cover member having a hole for receiving the lubricant filling port, wherein the lubricant filler structure is configured to extend from the crankcase to the hole.

11. The internal combustion engine of claim 10, wherein the cover member extends over the flywheel assembly.

12. The internal combustion engine of claim 10, wherein the lubricant filler structure further comprises a cap to close the lubricant filler tube, the cover member further comprises a recess, the hole being located in the recess, at least a portion of the cover member being disposed within the cowling assembly, and the highest elevation of the cap is below the highest elevation of the cover member.

13. An internal combustion engine for use with its crankshaft extending in a generally vertical direction, said internal combustion engine comprising an engine body, said engine body comprising a crankcase member, a cylinder block and a cylinder head, said crankcase member and said cylinder block being joined together to define a crankcase chamber, said crankshaft extending in a generally vertical direction through said crankcase chamber, at least one cylinder bore being formed in said cylinder block, a piston reciprocally mounted within said cylinder bore and being connected to said crankshaft, a flywheel being secured to said crankshaft and being disposed above an upper surface of said engine body, a cover member extending over said flywheel, an oil fill tube being connected to an upper portion of said crankcase member and said oil fill tube extending away from said cylinder head at an angle, wherein said cover member comprises a recess and said oil fill tube extends to said recess.

14. The engine of claim 13, wherein said oil fill tube has a removable cap and said removable cap can be accessed from above said cover member.

15. The engine of claim 14, wherein said removable cap is sized and configured such that no portion of said removable cap, when connected to said oil fill tube, extends above an upper surface of said cover.

16. The engine of claim 15, wherein said removable cap is further sized and configured such that no portion of said removable cap, when connected to said oil fill tube, extends above a wall formed around said recess, which wall at least partially defines said recess in said cover.

17. The engine of claim 13 further comprising an induction system, at least a portion of said induction system extending generally horizontally alongside a portion of said engine body, said oil fill tube extending within a gap defined between said portion of said engine body and said portion of said induction system.

18. The engine of claim 13 further comprising an induction system that comprises at least one plenum chamber that is attached to said engine body, said oil fill tube being disposed between said plenum chamber and said crankshaft.

* * * * *